US006941724B2

(12) United States Patent
Arrant et al.

(10) Patent No.: US 6,941,724 B2
(45) Date of Patent: Sep. 13, 2005

(54) SCREW CAPPING HEAD

(75) Inventors: Mark A. Arrant, Waukesha, WI (US); Ronald A. Kiesling, Pewaukee, WI (US)

(73) Assignee: Klockner KHS, Inc., Waukesha, WI (US)

( * ) Notice: Subject to any disclaimer, the term of this patent is extended or adjusted under 35 U.S.C. 154(b) by 30 days.

(21) Appl. No.: 10/164,252

(22) Filed: Jun. 6, 2002

(65) Prior Publication Data

US 2002/0184853 A1 Dec. 12, 2002

Related U.S. Application Data

(60) Provisional application No. 60/296,560, filed on Jun. 7, 2001.

(51) Int. Cl.[7] ..... B67B 3/10
(52) U.S. Cl. ..... 53/343; 173/178
(58) Field of Search ..... 173/176, 178; 310/106; 55/343, 317

(56) References Cited

U.S. PATENT DOCUMENTS

| | | | | |
|---|---|---|---|---|
| 3,715,865 | A | | 2/1973 | Davis |
| 3,757,487 | A | | 9/1973 | Fauth |
| 3,771,283 | A | | 11/1973 | Over et al. |
| 3,895,478 | A | | 7/1975 | Friendship |
| 3,974,884 | A | * | 8/1976 | Gidlund ..... 173/178 |
| 4,086,747 | A | | 5/1978 | Gorton et al. |
| 4,173,104 | A | | 11/1979 | Koll |
| 4,222,215 | A | | 9/1980 | Takano |
| 4,276,734 | A | | 7/1981 | de Fasselle et al. |
| 4,295,320 | A | | 10/1981 | Willingham |
| 4,304,611 | A | | 12/1981 | Ellis |
| 4,437,289 | A | | 3/1984 | Bedin |
| 4,535,583 | A | | 8/1985 | Tanaka et al. |
| 4,557,029 | A | | 12/1985 | Stewart |
| 4,562,685 | A | | 1/1986 | Tomita et al. |
| 4,571,920 | A | | 2/1986 | Roach et al. |
| 4,599,846 | A | | 7/1986 | Ellis et al. |
| 4,604,853 | A | | 8/1986 | Albrecht et al. |
| 4,608,806 | A | | 9/1986 | Haslam et al. |
| 4,633,646 | A | | 1/1987 | Ellis et al. |
| 4,658,565 | A | | 4/1987 | Westbrook et al. |
| 4,674,264 | A | | 6/1987 | Ellis et al. |
| 4,756,137 | A | | 7/1988 | Lanigan |
| 4,901,504 | A | | 2/1990 | Tsuji et al. |
| 4,905,447 | A | | 3/1990 | Margaria |
| 5,157,897 | A | | 10/1992 | McKee et al. |
| 5,313,765 | A | | 5/1994 | Martin |
| 5,321,935 | A | | 6/1994 | Spatz et al. |
| 5,327,697 | A | | 7/1994 | Kent |
| 5,339,597 | A | | 8/1994 | Naka et al. |
| 5,339,600 | A | | 8/1994 | Hamano et al. |
| 5,419,094 | A | | 5/1995 | Vander Bush, Jr. et al. |

(Continued)

OTHER PUBLICATIONS

Figs. A–D of a prior art KHS, Inc. Capping Head (with statement of relevance).

*Primary Examiner*—John Paradiso
(74) *Attorney, Agent, or Firm*—Michael Best & Friedrich LLP

(57) ABSTRACT

A screw capping head for use in a rotary capping machine includes a housing defining a longitudinal axis, a spindle rotatably carried by the housing, a first ring of magnets fixed within the housing, and a second ring of magnets coupled to the spindle for rotation with the spindle. The second ring of magnets is movable, without the use of tools, in the longitudinal direction with respect to both the spindle and the first ring of magnets to achieve a plurality of nested positions with respect to the first ring of magnets. The first and second rings of magnets define a magnetic torque coupling between the housing and the spindle, the strength of the torque coupling varying in a substantially linear relationship to the nested positions of the first and second rings of magnets.

20 Claims, 5 Drawing Sheets

U.S. PATENT DOCUMENTS 5,425,402 A 6/1995 Pringle
5,437,139 A 8/1995 Martin
5,467,527 A 11/1995 Zanini et al.
5,490,369 A 2/1996 Ellis et al.
5,531,057 A 7/1996 Coleman et al.
5,533,608 A 7/1996 Adams et al.
5,584,161 A 12/1996 Zanini et al.
5,623,806 A 4/1997 Larson et al.
5,653,564 A 8/1997 Nakamura
5,687,552 A 11/1997 Barca
5,809,742 A 9/1998 Takakusaki et al.
5,816,029 A 10/1998 Sweeny
5,996,311 A * 12/1999 Heard et al. ..... 53/317
6,041,571 A 3/2000 Fields et al.
6,240,678 B1 6/2001 Spether

* cited by examiner

SCREW CAPPING HEAD

RELATED APPLICATIONS

This application claims priority to U.S. Provisional Patent Application Ser. No. 60/296,560 filed on Jun. 7, 2001, which is incorporated herein by reference.

FIELD OF THE INVENTION

This invention relates generally to rotary capping machines, and more particularly to rotary capping machines that apply pre-threaded closures onto pre-threaded containers.

BACKGROUND OF THE INVENTION

Rotary capping machines for applying pre-threaded closures have been known for some time. To insure that a pre-threaded closure is not applied too loosely or too tightly and to insure product integrity, rotary capping machines are equipped with capping heads dependent upon a torque coupling. The torque coupling controls the application of torque to the closures to insure that they meet packaging specifications. Various types of torque couplings exist in the art such as mechanical clutches and magnetic clutches.

A magnetic clutch typically consists of axially-opposed rings that are spaced apart by some distance. Each ring comprises an array of magnets mounted horizontally along each ring whereby the arrays of magnets on the opposing rings are in a facing relationship. In a magnetic clutch, one ring is typically fixed within a housing that is driven by a machine spindle and the other ring drives a capping head spindle that holds the closures. The magnetic field established between the arrays of magnets is the connection between the torque applied to the housing by the machine spindle and the torque applied to the closure by the capping head spindle. Axial distance between the opposing rings affects the torque transmitted by the magnetic clutch. Generally, a greater distance between the rings will decrease the magnetic interaction between the opposing arrays of magnets, and subsequently will decrease the amount of transmittable torque carried by the magnetic clutch. Any resistance torque applied to the magnetic clutch by the spindle beyond that of the transmittable torque causes the clutch to slip. Generally, spacer rings are used to maintain the distance between the opposing magnetic rings.

In addition to the clutch, each capping head also typically utilizes a telescoping lower/upper housing design, with the clutch located in the lower housing near the spindle. A spring is usually positioned between the upper housing and lower housing to help bias the housings away from each other and to exert a top-loading force on the closure to the container. The pre-load on the spring can be adjusted to vary the top-loading force on the closure, and this is often accomplished using a rotatable collar with a locking element, such as a set screw, that must be loosened to adjust the collar and tightened after the adjustment is made. Alternatively, the spring can be removed and replaced with another spring of a different stiffness.

SUMMARY OF THE INVENTION

A typical capping head utilizing a magnetic clutch requires the use of tools for torque adjustment. To adjust the torque transmitted by the magnetic clutch, spacer rings must either be inserted or removed, depending on the design of the capping head. This often requires each capping head to be disassembled or adjusted using tools, and this extends the downtime associated with setting up a capping machine to run a specific package. After the capping head is adjusted, a torque wrench is required to verify the torque setting on the capping head. This is necessary to ensure all the capping heads on a rotary capping machine apply substantially the same amount of torque to closures on open containers.

Downtime is also extended when the top-loading force on the closure needs adjusting. Each capping head must be disassembled or adjusted using tools if the springs are to be replaced with springs of a different stiffness. If a capping head utilizes a collar with a locking element to adjust the top-loading force on the closure, then tooling is often required to carry out the adjustment. In either case, downtime is lengthened.

The typical capping head also requires seals such as o-rings and quad rings to prevent the environment and/or the product from entering and attacking the internal components of the capping head. The seals also prevent any lubrication in the capping head from escaping and contaminating the product being packaged. Failure of the seals often leads to a complete failure of the capping head. An erratic torque output also often results from worn or failed seals. To help prevent this from occurring, the capping heads require frequent maintenance to inspect and replace any worn seals and bearings.

The relatively large inertial mass of the capping head plus the friction of the seals often produce erratic torque output through the magnetic clutch. This is most common in high speed capping applications. To help address this problem, some capping machines have been provided with different sets of capping heads for different operating speed ranges. This approach has been helpful, but it has also been uneconomical and has unduly complicated and lengthened the changeover between packaging runs requiring two very different operating speeds. Prior attempts to reduce capping head inertia have been negligible at improving erratic torque output.

The magnetic clutch configuration utilizing two opposing magnetic rings that are in a facing relationship typically has a non-linear relationship between operating torque and the distance between the opposing magnets. This relationship is known in the art and has proven to be relatively unstable over time. As a result, each capping head may require frequent re-calibration to maintain accurate and repeatable closure applications on the containers. This practice also lengthens downtime and is uneconomical.

The invention provides for significant improvement for a screw capping head having a magnetic clutch for transmission of torque to a closure. The invention provides a capping head utilizing a single bearing and no conventional, resilient seals, therefore eliminating frictional resistance, extending maintenance intervals, reducing production downtime, and lowering the cost of operation.

More specifically, the invention provides in one embodiment a capping head having a torque coupling consisting of a magnetic clutch that yields a predictable torque output, thereby allowing for indexed torque adjustment and eliminating the need for frequent re-calibration of the capping heads. The magnetic clutch comprises two concentric rings with rectangular magnets affixed vertically along the rings. The rectangular magnets are preferably vacuum sealed in epoxy to provide corrosion protection from the environment. An outer ring is affixed to a lower housing while an inner ring is coupled around a spindle and positioned at least partially within the outer ring. The inner ring moves axially (and not rotationally) into and out of nested relationship with respect to the outer ring, which is fixed to the lower housing. This configuration yields a substantially linear relationship between operating torque and the axial distance or spacing between the concentric rings. This relationship is very stable over time and covers a wide range of operating torques, approximately between 5 in·lbs and 35 in·lbs.

In another embodiment, the invention provides a tool-less adjustment of the magnetic clutch. A torque-adjusting collar is rotatably adjustable around the spindle to initiate axial displacement of the inner magnet ring with respect to the fixed outer magnet ring, effectively eliminating the use of spacers to achieve a desired torque setting at the capping head. A detent mechanism is used to selectively lock and unlock the torque-adjusting collar, eliminating the need for any tooling or extended downtime to adjust the torque setting on the magnetic clutch to satisfy different closure specifications.

In another embodiment, the invention also provides a tool-less adjustment of the top-loading force applied by the spring to the closure. A combination of a spring retainer and an adjustment collar work to pre-load the spring between the upper housing and lower housing. The spring retainer is free to slide on the upper housing, while the adjustment collar is located above the retainer and is rotatably positioned using threads engaged with the upper housing. A clockwise rotation of the adjustment collar initiates a greater pre-load on the spring, and subsequently a greater top-loading force to the closure on the container. A counter-clockwise rotation yields the opposite results. One or more detent mechanisms are integrated between the adjustment collar and spring retainer to allow the collar to index between different amounts of pre-load on the spring. The detent mechanisms maintain and lock the collar in place during operation of the capping head.

In yet another embodiment, the invention provides a capping head without any conventional, resilient seals that require frequent replacement. Rather, a retainer positioned below the bearing includes an annular sidewall portion having a channel formed therein. The channel substantially prevents the liquid product from contaminating the bearing. Unlike a conventional resilient seal, however, the sidewall and channel of the metallic retainer do not wear over time. As a result, the magnetic clutch yields a more stable torque output for a longer period of time. To forego the use of conventional lubricants and resilient seals, while maintaining the bearing as the only conventionally lubricated component within the capping head, the other components that experience wear during normal operation can be coated to prolong their useful life. The coatings are applied directly to the wear surfaces of the respective components and will not contaminate the liquid product.

The invention also provides a method of adjusting the strength of the magnetic torque coupling on the capping head. The method includes rotating the torque adjusting collar relative to the spindle to impart an axial (and non-rotational) displacement of the inner ring of magnets relative to the outer ring of magnets between varying positions where the inner ring of magnets is nested within the outer ring of magnets, whereby varying the nested position of the two rings varies the strength of the torque coupling.

Other features and advantages of the invention will become apparent to those skilled in the art upon review of the following detailed description and drawings.

Figure 1:
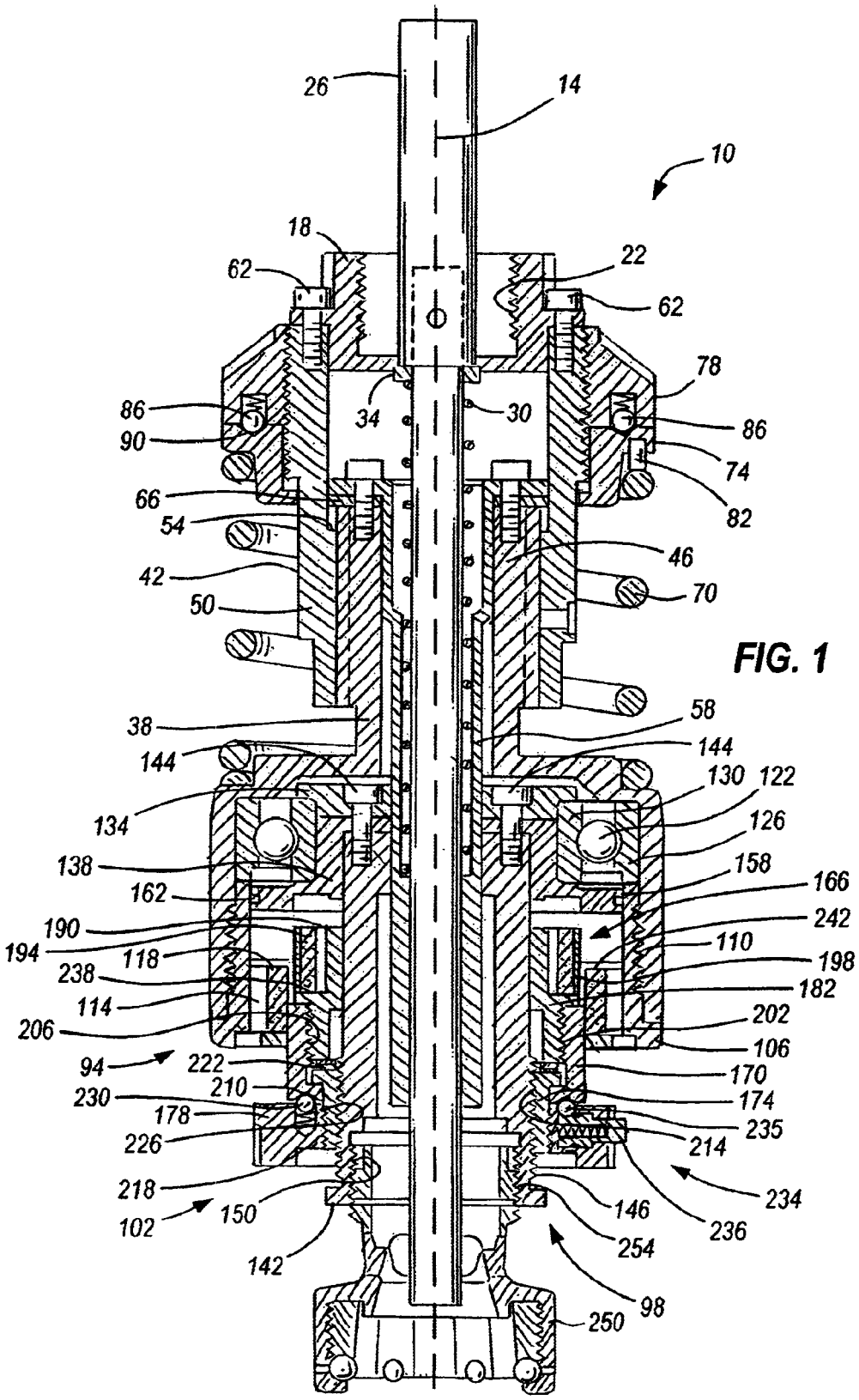
FIG. 1 is a cross-sectional view of a screw capping head embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

A screw capping headset, or capping head 10 embodying the present invention is shown in FIG. 1. The capping head 10 is rotatably driven along a longitudinal axis 14 by a machine spindle (not shown) of a capping machine (not shown). The machine spindle is secured to the screw capping head 10 via a spindle adapter 18. The spindle adapter 18 has internally formed threads 22 to secure the capping head 10 to the rotating spindle of the capping machine.

A knock-out rod 26 travels vertically through the capping head 10 to expel any unneeded or jammed closures (not shown) from the capping head 10. The knock-out rod 26 is biased towards an upper position by a compression spring 30. A spring retainer 34 axially aligns the spring 30 with respect to the knock-out rod 26 and is positioned between the knock-out rod 26 and the spring 30.

During operation, the knock-out rod 26 is actuated by the capping machine. When actuated, the knock-out rod 26 travels to a lower position where the rod 26 contacts and expels the unneeded closure. The spring 30 and retainer 34 then force the rod to return to the upper position.

Figure 2:
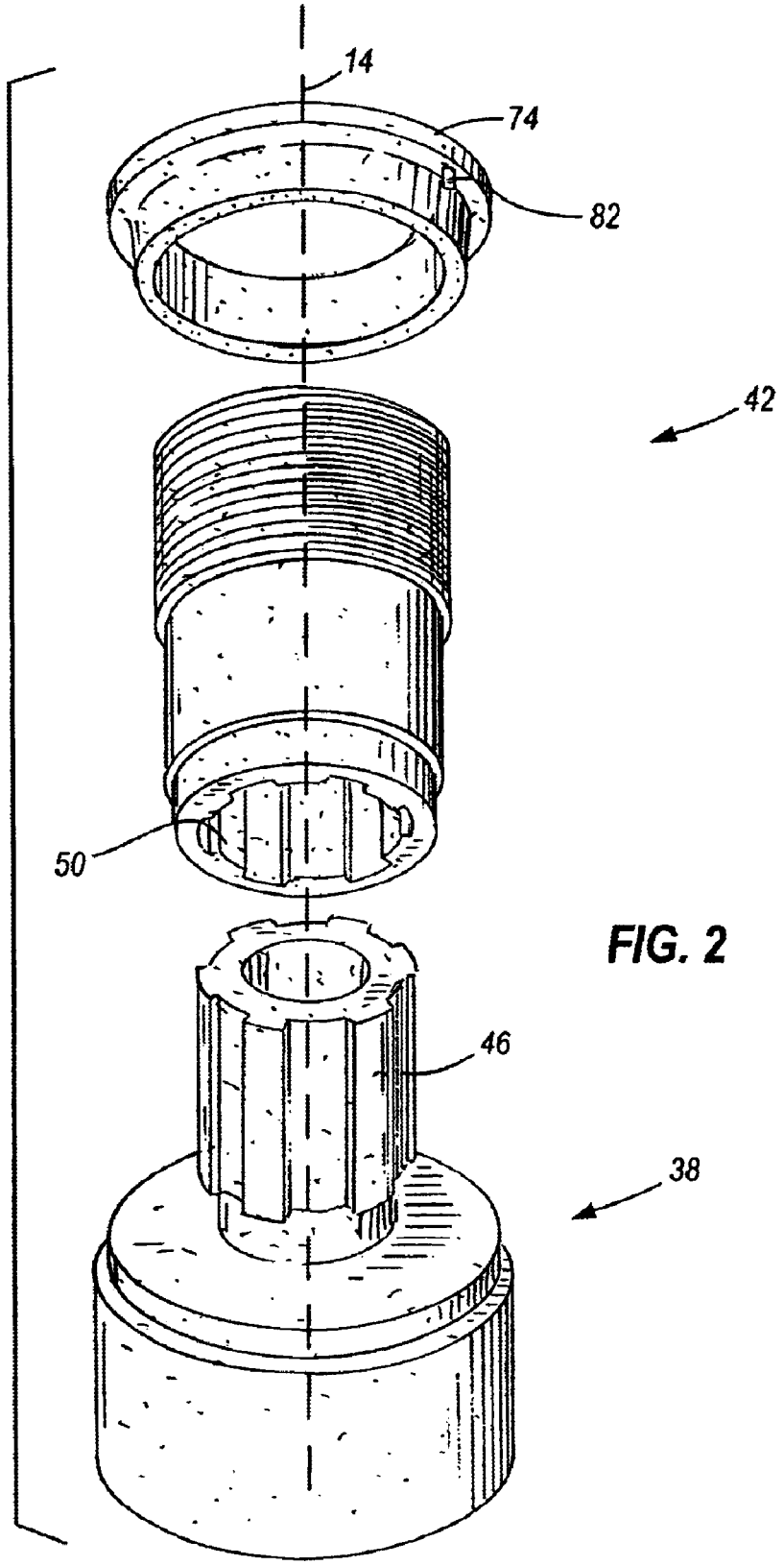
FIG. 2 is an exploded view showing the lower housing mating to the upper housing via male and female splines.

As best seen in FIG. 2, a lower housing 38 and an upper housing 42 are keyed together by splined shafts. The lower housing 38 includes a male splined shaft 46 and the upper housing 42 includes a female splined shaft 50, of course the lower housing 38 could include the female splined shaft 50 and the upper housing 42 could include the male splined shaft 46. The shafts 46, 50 engage each other and telescope coaxially along the longitudinal axis 14. With reference to FIG. 1, the upper housing 42 includes a circumferential ridge 54 concentric with the longitudinal axis 14. The housings 38, 42 are allowed to telescope a pre-determined distance as a result of a knock-out rod housing 58 contacting the ridge 54. The knock-out rod housing 58 secures the lower housing 38 to the upper housing 42 via eight cap screws 62 and prevents telescoping beyond the predetermined distance when the knock-out rod housing 58 comes into contact with the ridge 54. A shock absorber 66 in the form of an polymeric disc is positioned between the knock-out rod housing 58 and the lower housing 38 to decrease wear between the metallic surfaces of the housings 58, 38.

The upper housing 42 and portions of the lower housing 38 are coated to prolong their useful life and increase their corrosion resistance. The coatings can be applied by any conventional method such as spraying, dipping, or plating the components. In some instances, portions of a component will be coated rather than the entire component, and in other instances, the entire component will be coated for ease of application. The coated surfaces are indicated by the stippling seen in FIGS. 2, 4, 7–8.

The coating comprises a chrome-based coating having a thickness between about 0.0001 and 0.0003 inches and a hardness of about 78 Rc, however, different coatings having similar wear protection and corrosion resistance characteristics can also be used. The illustrated coating is marketed under the name ARMALOY and is available from Armaloy of Illinois, Inc. in DeKalb, Ill. By applying coatings to the wear surfaces of the capping head 10, such as the male and female splined shafts 46, 50, conventional lubricants like grease, oil, etc. are not required between the male and female splined shafts 46, 50. As a result, conventional resilient seals are also not required in the upper housing 42 or lower housing 38. Also, cleaning the capping heads 10 is highly simplified because the entire capping head 10 can be sprayed down using a high pressure water stream. Previously, the lubricated surfaces would have to be avoided during cleaning because the water stream could dissipate the lubrication from the lubricated surfaces.

A compression spring 70 is confined between a spring retainer 74 and the lower housing 38. The spring 70 biases the housings 38, 42 away from each other such that a force needs to be overcome for the housings 38, 42 to telescope toward each other. A top load adjusting nut 78 threadably engages the upper housing 42 and is positioned above the spring retainer 74. The nut 78 axially supports the retainer 74 against the force of the compression spring 70. Rotation of the nut 78 results in its axial movement along the longitudinal axis 14. The nut 78 can be rotatably adjusted to displace the retainer 74 and compress the spring 70. This action imparts a pre-load on the spring 70. This ensures the closure will be vertically applied to an open container (not shown) by a minimum force determined by the pre-load.

The pre-load can be adjusted by rotating the nut 78 to increase or decrease the pre-load as required by closure application specifications. The retainer 74 includes an anti-rotation pin 82 that prevents the spring 70 from rotating relative to the housings 38, 42 during operation. The retainer 74 is also coated similar to the upper housing 42 and lower housing 38. The nut 78 includes four ball detent mechanisms 86 that engage four correlating recesses 90 in the retainer 74 and secure the nut 78 to prevent any unwanted rotation during operation of the capping head 10. Alternatively, the nut 78 can utilize other locking mechanisms, such as one or more setscrews (not shown) to secure the nut 78.

The lower housing 38 contains the components involved with the magnetic torque coupling of the capping head 10. The components generally include an outer magnet assembly 94, a spindle assembly 98, and a torque carrier assembly 102.

Figure 5:
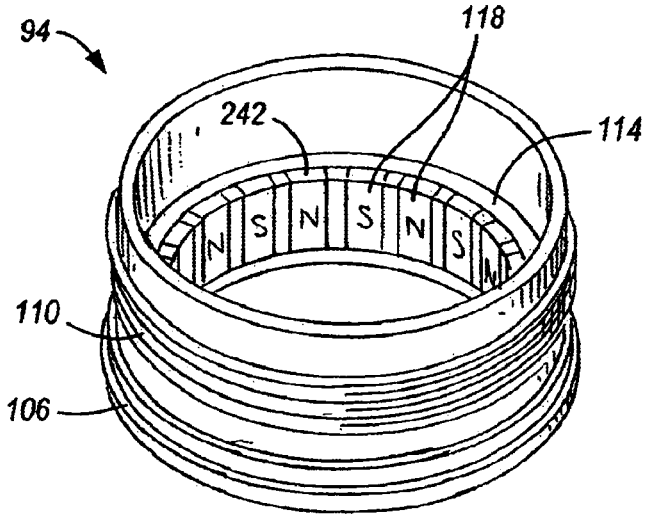
FIG. 5 illustrates the outer magnet assembly of the screw capping head of FIG. 1.

As shown in FIGS. 1 and 5, the outer magnet assembly 94 includes an outer carrier housing 106 having exterior threads 110 for threaded engagement with the lower housing 38. The outer carrier housing 106 includes an outer ring 114 that is shrink fit into the interior of the housing 106. The outer ring 114 is layered with a single row of outer magnets 118 positioned in a circular array. In the illustrated embodiment, the inside diameter of the outer ring 114 with the attached magnets 118 is about 2.125 inches. The magnets 118 are preferably made of a Sumarium Cobalt or similar magnetic material, with each magnet 118 having poles of opposite charge (e.g. a north and south pole). The magnets 118 are positioned on the outer ring 114 with either a north or south pole exposed to the interior of the outer magnet assembly 94 such that each magnet 118 has an adjacent magnet 118 with an opposite pole exposed. The magnets 118 are vacuum sealed and secured to the outer ring 114 by epoxy.

As best seen in FIG. 1, the spindle assembly 98 includes a ball bearing 122 having an outer race 126 axially disposed between the outer carrier housing 106 and the lower housing 38. As a result, the outer race 126 is rotatably fixed with respect to the lower housing 38. The inner race 130, however, is free to rotate independently of the lower housing 38 and is axially disposed between an upper bearing retainer 134 and a lower bearing retainer 138. A capping head spindle 142 (hereinafter referred to as the "spindle") is secured to the upper bearing retainer 134 and lower bearing retainer 138 through six cap screws 144 and is free to rotate about the longitudinal axis 14. The spindle 142 (see FIGS. 1 and 7) includes both exterior threads 146 and interior threads 150 on the lower portion of the spindle 142. The spindle 142 also includes male splines 154 on its exterior surface towards the upper portion of the spindle 142. The spindle 142 is also coated with the ARMALOY coating like the upper housing 42 and lower housing 38 to enhance wear protection and corrosion resistance.

The lower bearing retainer 138 includes an annular portion or sidewall 158 having a channel 162 formed therein. The channel 162 is positioned below the bearing 122 and communicates with the outer carrier housing 106. The sidewall 158 is closely spaced to the inner surface of the outer carrier housing 106 with the channel 162 extending radially inwardly toward the longitudinal axis 14. The channel 162 substantially prevents the liquid product from contaminating the bearing 122 by providing a collection area for any liquid product coming in contact with the sidewall 158. Unlike a conventional resilient seal that is typically in sliding frictional contact with another mating surface, the sidewall 158 of the lower bearing retainer 138 is not in frictional contact with another surface and subsequently does not wear over time.

The bearing 122 is lubricated using a food-grade type grease that substantially adheres to the lubricated surfaces of the bearing 122. As a result, the channel 162 typically is not needed to prevent unwanted movement of bearing grease away from the bearing 122 and toward the liquid product.

Figure 3:
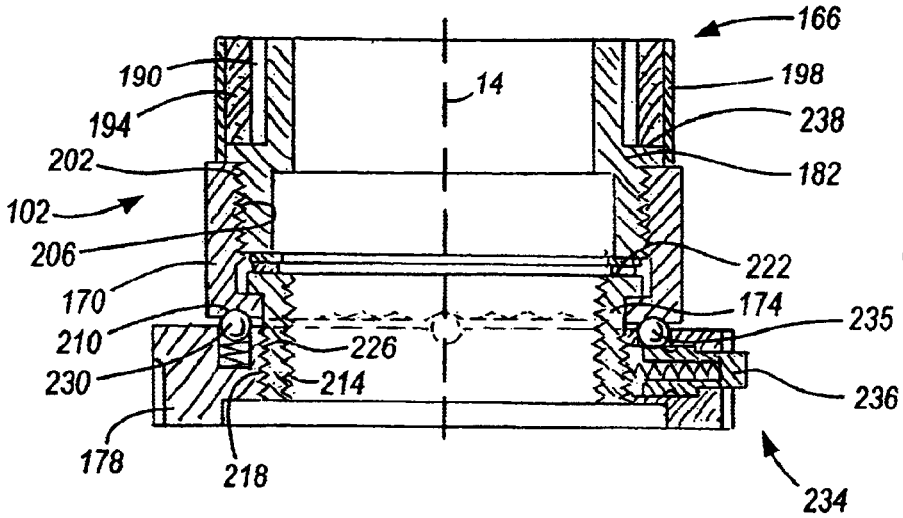
FIG. 3 is a cross-sectional view of the torque carrier assembly of the screw capping head of FIG. 1.
Figure 4:
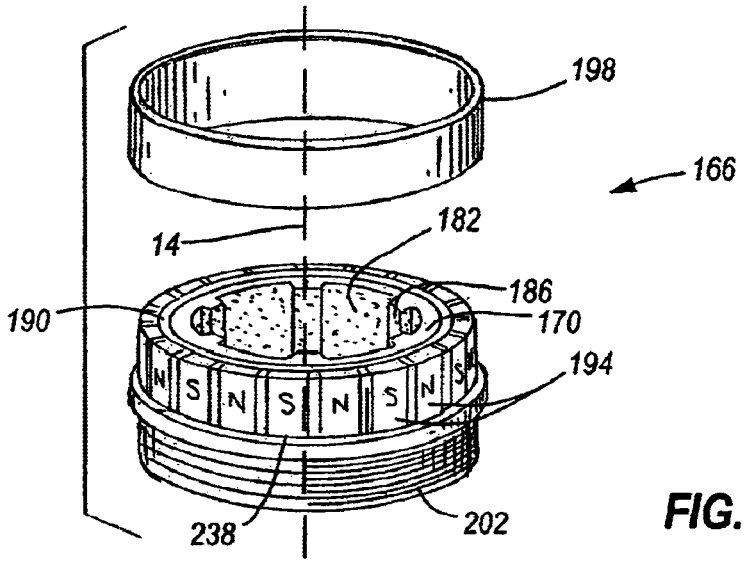
FIG. 4 illustrates the inner magnet assembly of the screw capping head of FIG. 1.

The torque carrier assembly 102 is positioned partially within the lower housing 38 and telescopes axially with respect to the spindle 142 along the longitudinal axis 14. The torque carrier assembly 102 includes an inner magnet assembly 166, a carrier ring 170, a carrier coupling 174, and a torque-adjusting collar 178. The torque carrier assembly 102 is shown in greater detail in FIG. 3.

The inner magnet assembly 166 (see FIG. 4) includes an inner magnet carrier 182 having female splines 186 on the interior of the carrier 182. The female splines 186 engage the male splines 154 of the spindle 142 to allow the inner magnet assembly 166, and subsequently the torque carrier assembly 102, to telescope axially with respect to the spindle 142. The splined engagement between the inner magnet assembly 166 and the spindle 142 also prevents rotation of the inner magnet assembly 166 relative to the spindle 142. Of course, the inner magnet carrier 182 could have male splines 154 that engage female splines 186 of the spindle 142.

The female splines 186 of the inner magnet carrier 182 and the male splines 154 of the spindle 142 are also coated with the same coating applied to the upper housing 42 and lower housing 38. As a result, conventional resilient seals are not required in the torque carrier assembly 102 because conventional lubricants are not needed. The inner magnet carrier 182 includes an inner ring 190 that is shrink fit over the inner magnet carrier 182.

The inner ring 190 is layered with a single row of inner magnets 194 positioned in a circular array. The magnets 194 are also preferably made of a Sumarium Cobalt or similar magnetic material, with each magnet 194 having poles of opposite charge (e.g. a north and south pole). The magnets 194 are also positioned on the inner ring 190 with either a north or south pole exposed to the exterior of the inner magnet assembly 166 such that each magnet 194 has an adjacent magnet 194 with an opposite pole exposed. The magnets 194 are vacuum sealed and secured to the inner ring 190 by epoxy. A sleeve 198 is shrink fit over the circular array of magnets 194 to lend additional radial support to the magnets 194. In the illustrated embodiment, the outer diameter of the inner ring 190 with the attached magnets 194 and sleeve 198 is about 2.1 inches. As a result, about 0.0125 inches of clearance exists between the inner magnet assembly 166 and outer magnet assembly 94. This clearance allows the inner and outer magnet assemblies 166, 94 to achieve a variety of coaxially nested positions with respect to one another. The inner magnet carrier 182 also includes exterior threads 202 on the lower portion of the carrier 182.

Figure 7:
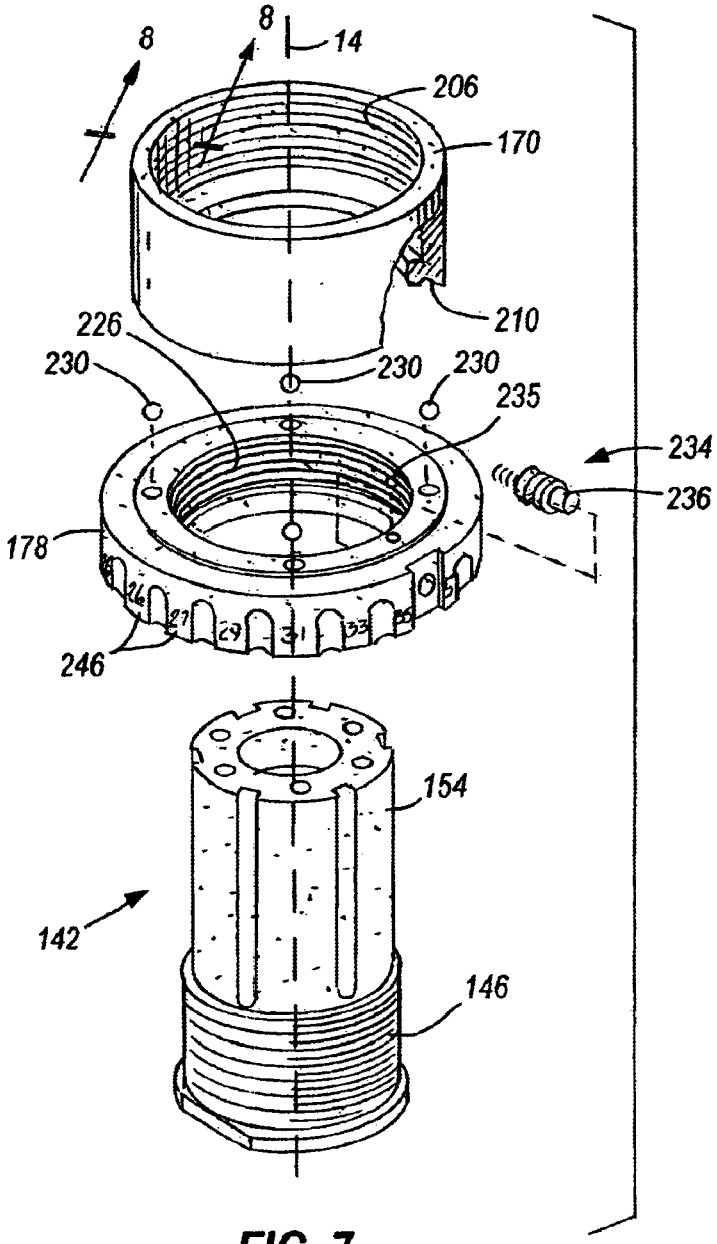
FIG. 7 illustrates the spindle, torque adjusting collar with detent mechanisms, and the carrier ring.
Figure 8:
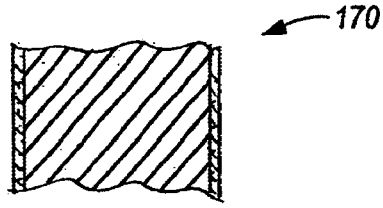
FIG. 8 is a cross-section view along lines 8—8 of the carrier ring of FIG. 7.

Referring again to FIGS. 1 and 3, the carrier ring 170 includes interior threads 206 for threaded engagement with the exterior threads 202 of the inner magnet carrier 182. The carrier ring 170 also includes a plurality of indexed recesses 210 or detents (see FIGS. 3 and 7) radially positioned around the bottom surface of the carrier ring 170 for receiving spring-loaded balls described below. As shown in FIGS. 7 and 8, the carrier ring 170 is coated similarly to the inner magnet carrier 182 to enhance wear protection and corrosion resistance.

The carrier coupling 174 includes interior threads 214 for threaded engagement with the spindle 142. The carrier coupling 174 also includes exterior threads 218. One or more bushings 222 are positioned between the contacting surfaces of the inner magnet carrier 182 and the carrier coupling 174 to minimize wear between the carrier 182 and the coupling 174.

As shown in FIGS. 1 and 7, the torque-adjusting collar 178 includes interior threads 226 for threaded engagement with the exterior threads 218 of the carrier coupling 174. The torque-adjusting collar 178 is also coated similarly to the inner magnet carrier 182 to enhance wear protection and corrosion resistance. The collar 178 also includes four ball detent mechanisms 230 radially positioned on the top surface of the collar 178. The ball detent mechanisms 230 are equiangularly spaced to coincide with the indexed recesses 210 of the carrier ring 170.

The collar 178 also includes one locking ball detent mechanism 234 having a ball 235 actuated by a spring-biased push button 236. The locking ball detent mechanism 234 rotatably locks the torque-adjusting collar 178 to the carrier ring 170, which is coupled to the spindle 142 for rotation therewith. When the push button 236 is depressed, the ball 235 disengages the carrier ring 170 and the collar 178 is allowed to co-rotate with the carrier coupling 174 about the exterior threads 146 of the spindle 142. This action results in an axial displacement of the inner magnet assembly 166 with respect to the outer magnet assembly 94. Utilizing the locking ball detent mechanism 234 in conjunction with the rotatably adjustable collar 178 allows the torque coupling between the magnet assemblies 94, 166 to be changed by hand without using tools.

Figure 6:
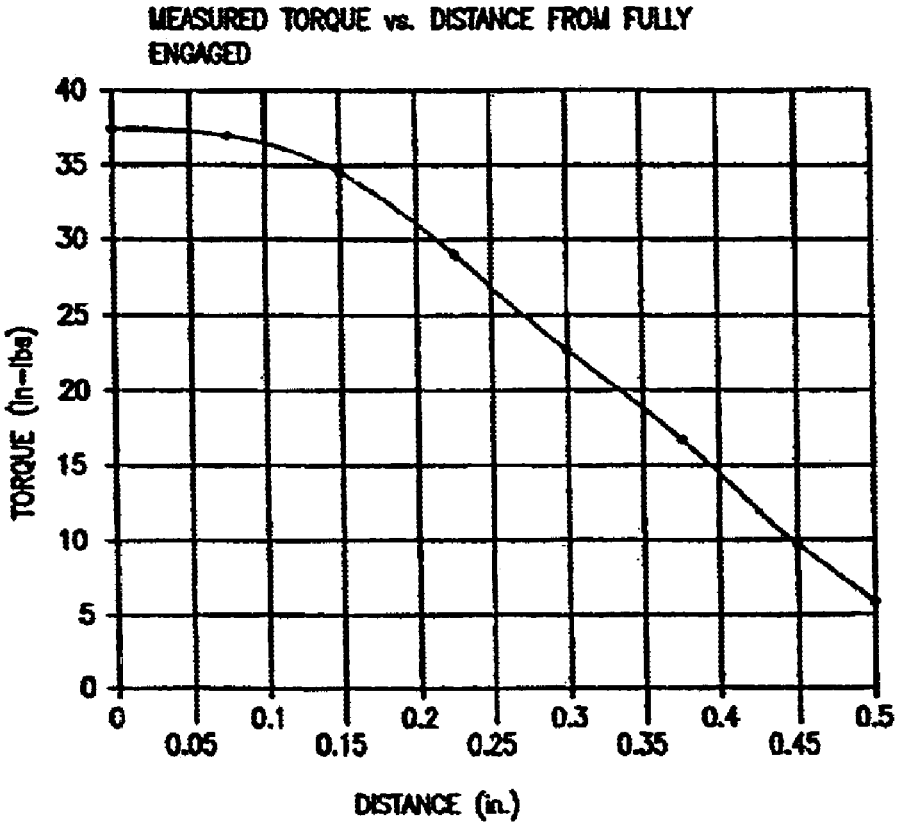
FIG. 6 is a Torque vs. Distance curve illustrating the relationship between torque applied by the capping head to a closure and the spaced distance between the inner and outer magnet assemblies.

The combination of the ball detent mechanisms 230 in the torque-adjusting collar 178 and the indexed recesses 210 in the carrier ring 170 allows the collar 178 to selectively index the axial position of the inner magnets 194 with respect to the outer magnets 118. This configuration allows the capping head 10 to take advantage of the substantially linear relationship between the torque coupling of the nested magnets 118, 194 and the vertical distance between the nested magnets 118, 194. This substantially linear relationship is shown in FIG. 6. Using this configuration, the capping head 10 can be adjusted to transmit between 5 in·lbs and 35 in·lbs of torque to a closure.

In the illustrated embodiment shown in FIG. 1, a clockwise rotation (looking from the bottom of the capping head 10) of the torque-adjusting collar 178 causes the inner magnets 194 to displace axially away from (upwardly in FIG. 1) the outer magnets 118. In a fully displaced position, the inner magnets 194 yield the weakest torque coupling with the outer magnets 118, while a home position yields the strongest torque coupling between the magnets 118, 194. In the illustrated embodiment, the home position is defined when the inner magnets 194 are completely nested within the outer magnets 118, while the fully displaced position is defined by about 0.5 inches of vertical upward movement of the inner magnets 194, where the bottom surfaces 238 of the inner magnets 194 are coplanar with the top surfaces 242 of the outer magnets 118.

The position of the inner magnets 194 relative to the outer magnets 118 is generally identified by reference numerals 246 engraved on the exterior of the collar 178, as shown in FIG. 7. The numerals 246 are indexed and referenced to a calibration mark (not shown) on the carrier ring 170. This allows a user to visually determine the torque setting of the capping head 10. Generally, a lower numeral referenced to the calibration mark indicates a weaker torque coupling while a higher numeral referenced to the mark indicates a stronger torque coupling. The reference numerals 246 correlate to the actual amount of torque applied by the capping head 10 to a closure, such that the numeral "29" referenced to the calibration mark indicates that a torque of 29 in·lbs is applied to a closure. With this configuration, a torque wrench is not required to verify torque settings on individual capping heads 10 during a product changeover.

As shown in FIG. 1, the capping head 10 also includes a chuck assembly 250 rotatably supported within the spindle 142. Exterior threads 254 on the chuck assembly 250 engage the interior threads 150 of the spindle 142 to secure the chuck assembly 250 to the spindle 142 for rotation therewith. A closure is secured within the chuck assembly 250 for application to an open container.

During operation, the capping head 10 is pre-set to apply an amount of torque required by a production run of a particular open container. This is done by indexing the torque-adjusting collar 178 to the level of torque coupling desired. Upon application of the closure, the chuck assembly 250 will slip with the spindle 142 when the pre-set amount of torque is applied to the closure. This occurs because the torque coupling between the inner magnets 194 and outer magnets 118 is overcome.

When the spindle 142 slips, the spindle 142 ratchets due to alternating attraction and repulsion between the outer magnets 118 and inner magnets 194. For example, the outer magnets 118 with exposed "north" poles will attract the inner magnets 194 with exposed "south" poles to define a stable position between the outer magnets 118 and inner magnets 194. Conversely, the outer magnets 118 with exposed "north" poles will repulse the inner magnets 194 with exposed "north" poles to define an unstable position between the outer magnets 118 and inner magnets 194. The magnets 118, 194 alternating between stable and unstable positions cause the spindle 142 to ratchet when the spindle 142 slips. This ratcheting effect is advantageous for some closure applications and provides benefits over other prior art magnetic clutches that operate using the hysteresis phenomenon to provide smooth clutch action.

The absence of conventional resilient seals enhances the performance and longevity of the capping head 10. Generally, when conventional resilient seals wear, the relationship between torque coupling and axial distance between the magnets 118, 194 breaks down and becomes increasingly unstable. Since the present invention does not utilize conventional resilient seals, the torque coupling relationship remains stable and the capping head 10 can utilize longer maintenance intervals between servicing or replacement. This also allows the capping head 10 to more accurately and precisely apply the closures with a pre-set amount of torque, which will subsequently decrease the number of rejected product containers due to improper application of closures to the open containers.

Various features of the invention are set forth in the following claims.

We claim:

1. A capping head for use with a rotary capping machine, the capping head comprising:

a housing;

a spindle supported in the housing for rotation therewith, the spindle defining a longitudinal axis;

a first ring of magnets fixed within the housing and having a first diameter; and a second ring of magnets coupled to the spindle for co-rotation with the spindle such that relative rotation between the spindle and the second ring of magnets is substantially prevented, the second ring of magnets being movable in the longitudinal direction with respect to both the spindle and the first ring of magnets, and the second ring of magnets having a second diameter different from the first diameter such that the first and second rings can achieve a plurality of nested positions with respect to one another to define a magnetic torque coupling between the housing and the spindle.

2. The capping head of claim 1, wherein a strength of the torque coupling varies in a substantially linear relationship to the nested positions of the first and second rings of magnets.

3. The capping head of claim 1, wherein the first diameter is larger than the second diameter such that the second ring of magnets is allowed to nest within the first ring of magnets.

4. The capping head of claim 1, further comprising a magnet carrier coupled to the spindle for co-rotation with the spindle such that relative rotation between the spindle and the magnet carrier is substantially prevented, wherein the second ring of magnets is carried on the magnet carrier.

5. The capping head of claim 4, wherein the spindle includes splines and the magnet carrier includes splines engaging the splines of the spindle for relative movement in only the longitudinal direction.

6. The capping head of claim 5, wherein the splines on the spindle and the splines on the magnet carrier are coated with a friction-reducing coating.

7. The capping head of claim 4, further comprising a collar coupled to the magnet carrier to impart movement to the magnet carrier in the longitudinal direction.

8. The capping head of claim 7, wherein the collar is rotated relative to the spindle to impart movement to the magnet carrier in the longitudinal direction.

9. The capping head of claim 8, wherein the collar includes a locking-ball detent mechanism to selectively lock and unlock rotation of the collar relative to the spindle, the locking-ball detent mechanism being operable by hand without using tools.

10. The capping head of claim 9, wherein the locking-ball detent mechanism includes a spring-biased button.

11. The capping head of claim 1, wherein the housing further includes an inner surface and defines an upper portion and a lower portion, and wherein the capping head further comprises:

a bearing positioned within the upper portion of the housing; and a retainer between the bearing and the lower portion, the retainer including an annular sidewall facing the inner surface of the housing and having therein a channel, the channel being the only sealing feature between the upper and lower portions of the housing.

12. The capping head of claim 11, wherein the channel extends completely around the sidewall.

13. The capping head of claim 11, wherein the channel substantially prevents movement of contaminants toward the bearing.

14. A capping head for use with a screw capping machine, the capping head comprising:

a first housing defining a longitudinal axis and having an inner surface;

a second housing at least partially received within the first housing and having an outer surface engaged with the inner surface to permit relative movement between the first housing and the second housing in the longitudinal direction;

a spring between the first and second housings to bias the first and second housing away from one another;

a spindle supported in the second housing for rotation therewith;

a chuck assembly coupled to the spindle for rotation with the spindle and configured to apply a closure to a container;

a coating applied to at least one of the inner and outer surfaces to reduce friction between the inner and outer surfaces during relative movement of the housings in the longitudinal direction;

a first ring of magnets fixed within the second housing and having a first diameter; and a second ring of magnets coupled to the spindle for rotation with the spindle, the second ring of magnets being movable in the longitudinal direction with respect to both the spindle and the first ring of magnets, and the second ring of magnets having a second diameter different from the first diameter such that the first and second rings can achieve a plurality of nested positions with respect to one another;

wherein the first and second rings of magnets define a magnetic torque coupling between the second housing and the spindle, a strength of the torque coupling varying in a substantially linear relationship to the nested positions of the first and second rings of magnets.

15. The capping head of claim 14, wherein the coating is chrome-based.

16. The capping head of claim 14, wherein the coating is between about 0.0001 and 0.0003 inches thick.

17. The capping head of claim 14, wherein the coating has a hardness of approximately 78 Rc.

18. The capping head of claim 14, further comprising an adjusting nut coupled to one end of the spring to permit compression and expansion of the spring in the longitudinal direction in response to rotation of the adjusting nut, the adjusting nut being adjustable without using tools.

19. The capping head of claim 18, further comprising:

a retainer between the adjusting nut and the spring; and a ball detent mechanism between the adjusting nut and the retainer to substantially prevent rotation of the adjusting nut during operation of the capping head.

20. A capping head for use with a rotary capping machine, the capping head comprising:

a first housing defining a longitudinal axis and having an inner surface;

a second housing including an inner surface and defining an upper portion and a lower portion, the second housing being at least partially received within the first housing and having an outer surface engaged with the inner surface of the first housing to permit relative movement between the first housing and second housing in the longitudinal direction;

a coating applied to at least one of the inner surface of the first housing and the outer surface of the second housing to reduce friction between the surfaces during relative movement of the housings in the longitudinal direction;

a bearing positioned within the upper portion of the second housing;

a spindle supported by the bearing within the second housing for rotation therewith about the longitudinal axis;

a retainer between the bearing and the lower portion, the retainer including an annular sidewall facing the inner surface of the second housing and having therein a channel, the channel being the only sealing feature between the upper and lower portions of the second housing;

a first ring of magnets fixed within the second housing and having a first diameter;

a second ring of magnets coupled to the spindle for rotation with the spindle, the second ring of magnets being movable in the longitudinal direction with respect to both the spindle and the first ring of magnets, and the second ring of magnets having a second diameter different from the first diameter such that the first and second rings can achieve a plurality of nested positions with respect to one another;

wherein the first and second rings of magnets define a magnetic torque coupling between the second housing and the spindle, a strength of the torque coupling varying in a substantially linear relationship to the nested positions of the first and second rings of magnets.

* * * * *